US006085920A

United States Patent [19]

Moretti

[11] Patent Number: 6,085,920

[45] Date of Patent: Jul. 11, 2000

[54] CHILDPROOF CLOSURE FOR BOTTLES IN GENERAL WITH EASIER OPERATION AND IMPROVED SAFETY

[75] Inventor: Cesare Moretti, Cinisello Balsamo, Italy

[73] Assignee: Phaba S.r.l., Concorezzo, Italy

[21] Appl. No.: 09/057,491

[22] Filed: Apr. 9, 1998

[30] Foreign Application Priority Data

Apr. 18, 1997 [IT] Italy ..... MI97A0925

[51] Int. Cl.[7] ..... B65D 50/04; B65D 41/34

[52] U.S. Cl. ..... 215/220; 215/252; 215/277

[58] Field of Search ..... 215/216, 217, 215/218, 219, 220, 221, 223, 250, 252, 253, 258, 277, 329, 330, 334; 220/255, 256, 258, 266

[56] References Cited

U.S. PATENT DOCUMENTS

| | | | |
|---|---|---|---|
| 3,843,006 | 10/1974 | Naito et al. | 215/220 |
| 3,857,505 | 12/1974 | Mumford et al. | 215/220 |
| 3,972,436 | 8/1976 | Grau | 215/220 |
| 4,365,722 | 12/1982 | Kramer | 215/220 |
| 4,410,098 | 10/1983 | Dubs et al. | 215/220 |
| 5,020,681 | 6/1991 | Kusz | 215/220 |
| 5,590,799 | 1/1997 | King | 215/216 |
| 5,611,443 | 3/1997 | King | 215/220 |
| 5,615,787 | 4/1997 | Morris, Sr. | 215/217 |
| 5,667,085 | 9/1997 | Ogden et al. | 215/220 |

*Primary Examiner*—Stephen K. Cronin
*Assistant Examiner*—Nathan Newhouse
*Attorney, Agent, or Firm*—Guido Modiano; Albert Josif; Daniel O'Byrne

[57] ABSTRACT

A childproof closure for bottles in general with easier operation and improved safety, including a hood, which can be rigidly coupled to a metal cap which can be screwed onto the neck of a bottle and the like, and an outer cap, which can be superimposed on the metal cap and the hood. Axial protrusions are provided on the base of the hood which can be detachably coupled to inner teeth formed by the outer cap. Elastic means are furthermore provided for axially spacing the bottom of the outer cap and the base of the hood and are suitable to allow the engagement of the axial protrusions and of the inner teeth in order to rigidly rotationally couple the outer cap and the hood when axial compression is applied to the outer cap.

4 Claims, 3 Drawing Sheets

CHILDPROOF CLOSURE FOR BOTTLES IN GENERAL WITH EASIER OPERATION AND IMPROVED SAFETY

BACKGROUND OF THE INVENTION

The present invention relates to a childproof closure for bottles in general with easier operation and improved safety.

It is known that bottles, particularly for medicines and the like, are currently closed with a childproof safety by using aluminum caps to which an external plastic cap is applied which provides the safety; as an alternative, closures are provided by means of an inner cap and an outer cap which are entirely made of plastics, for example of the kind commercially known by the trademark MOPLEN.

When using aluminum caps, an outer cap is applied over it which is movable with respect to said aluminum cap, so as to cause a knurling, at the bottom region, to couple to the knurling provided proximate to the base of the aluminum cap, thus rigidly rotationally coupling the two elements.

In order to obtain this coupling, it is necessary to apply compression to overcome the elastic force provided by tabs which protrude from the bottom of the outer cap and rest on the bottom of the aluminum cap, keeping the outer cap in raised position.

This closure has the drawback that it is also necessary to perform compression when one wishes to close the bottle, in order to make the knurlings mutually couple.

This fact often causes drawbacks, especially in the case of elderly people who are unable to correctly close the bottle, thus producing a potential danger, since the bottle remains substantially in an open position.

Closures provided by means of inner caps and outer caps both made of plastics entail the advantage that rotational coupling is provided by means of axial protrusions formed on the inner cap, which engage inner teeth provided correspondingly on the inner face of the outer cap.

The tabs that act as an elastic element are also capable of coupling, by virtue of the rotation of the closure in the screw-on direction, to raised portions formed on the upper face of the inner cap, thus rigidly rotationally coupling the inner cap and the outer cap in the closing direction without having to apply compression.

However, although they provide this advantage, caps made entirely of plastics have the drawback that they are usually difficult to open, since it is generally difficult to break the safety collar because the plastic material provides connections which are not always easy to break.

Moreover, a drawback which is common to closures with a cap made of plastics and aluminum and to those made entirely of plastics is constituted by the fact that it is often possible to rigidly rotationally couple the outer cap to the inner cap simply by applying radial compression, which by virtue of the deformation of the outer cap rigidly couples it to the inner cap; this fact is particularly negative, since radial compression is a typical behavior and action of children, who tighten their fingers around the cap and can thus neutralize the safety, inappropriately achieving opening.

SUMMARY OF THE INVENTION

The aim of the present invention is to eliminate the above drawbacks by providing a childproof closure for bottles in general with easier operation and improved safety, which can be easily opened without requiring particular effort and has, in this respect, the typical characteristics of aluminum caps but at the same time eliminates the closure difficulties that are typical of aluminum-cap closures.

Within the scope of this aim, a particular object of the invention is to provide a childproof closure which allows to prevent the rigid coupling of the outer cap and of the inner cap in case of radial compression, thus providing effective safety for closure.

Another object of the present invention is to provide a childproof closure which is capable of giving the greatest assurances of reliability and safety in use by virtue of its particular constructive characteristics.

Another object of the present invention is to provide a childproof closure which can be easily obtained starting from commonly commercially available elements and materials and is furthermore competitive from a purely economical point of view.

This aim, these objects and others which will become apparent hereinafter are achieved by a childproof closure for bottles in general with easier operation and improved safety, according to the invention, comprising a hood rigidly coupleable to a metal cap which can be screwed onto the neck of a bottle and the like, and an outer cap, which can be superimposed on said metal cap and said hood, axial protrusions being provided on the base of said hood which can be detachably coupled to inner teeth formed by said outer cap, elastic means being furthermore provided for axially spacing the bottom of said outer cap and the base of said hood and being adapted to allow the engagement of said axial protrusions and of said inner teeth in order to rigidly rotationally couple said outer cap and said hood by applying axial compression to said outer cap.

BRIEF DESCRIPTION OF THE DRAWINGS

Further characteristics and advantages of the present invention will become apparent from the following detailed description of a preferred but not exclusive embodiment of a childproof closure for bottles in general with easier operation and improved safety, illustrated only by way of non-limitative example in the accompanying drawings, wherein.

DESCRIPTION OF THE PREFERRED EMBODIMENTS

Figure 1:
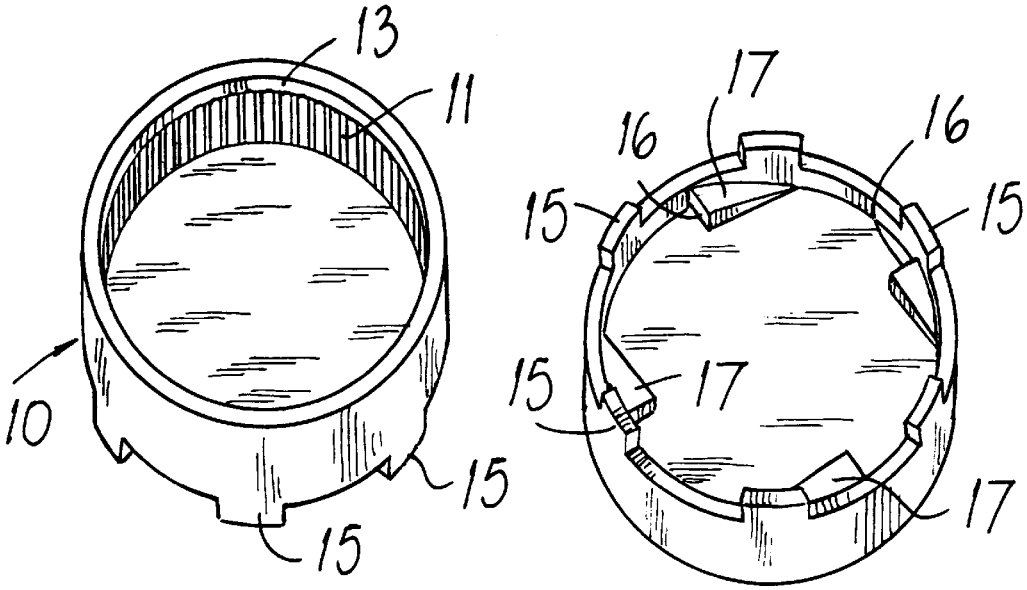
FIG. 1 is a schematic perspective view of the outer cap and of the hood.
Figure 1:
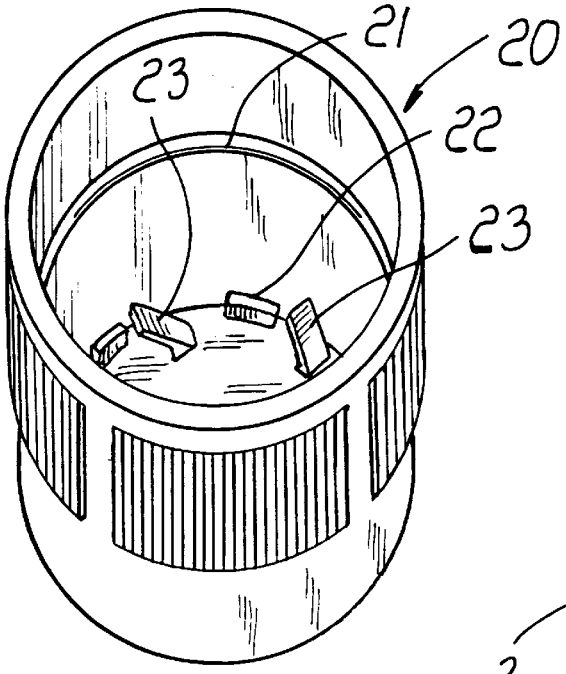
Figure 2:
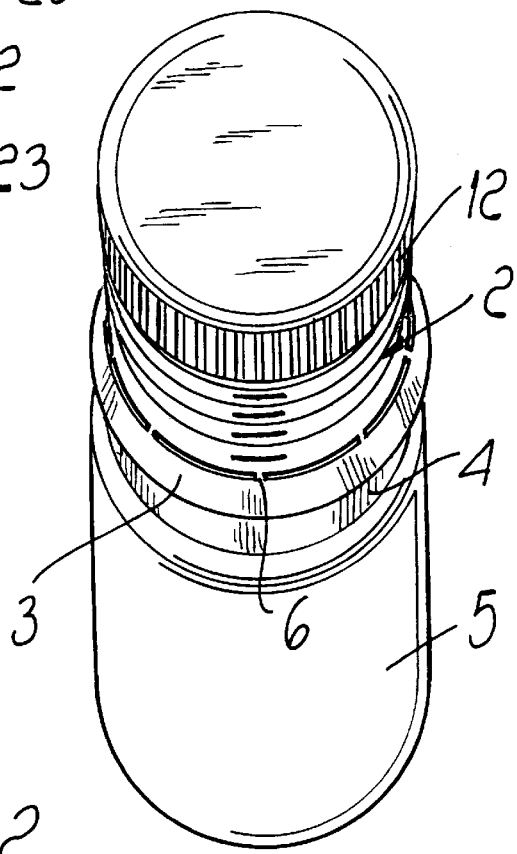
FIG. 2 is an exploded view of a bottle with a metal cap and the hood applied thereto.

With reference to the above figures, the childproof closure for bottles in general with easier operation and improved safety, according to the invention, is generally designated by the reference numeral 1 and comprises a metal cap 2, generally made of aluminum, which is connected to a collar 3 which is seamed onto the neck 4 of a bottle, generally designated by the reference numeral 5.

The ordinary safety bridges 6, which must be broken on first opening, are provided between the collar 3 and the cap 2.

A hood 10 can be applied on the metal cap 2, which can be screwed onto the neck 4 of the bottle 5, the hood being rigidly rotationally coupled to the cap 2.

Figures 3, 4, 5:
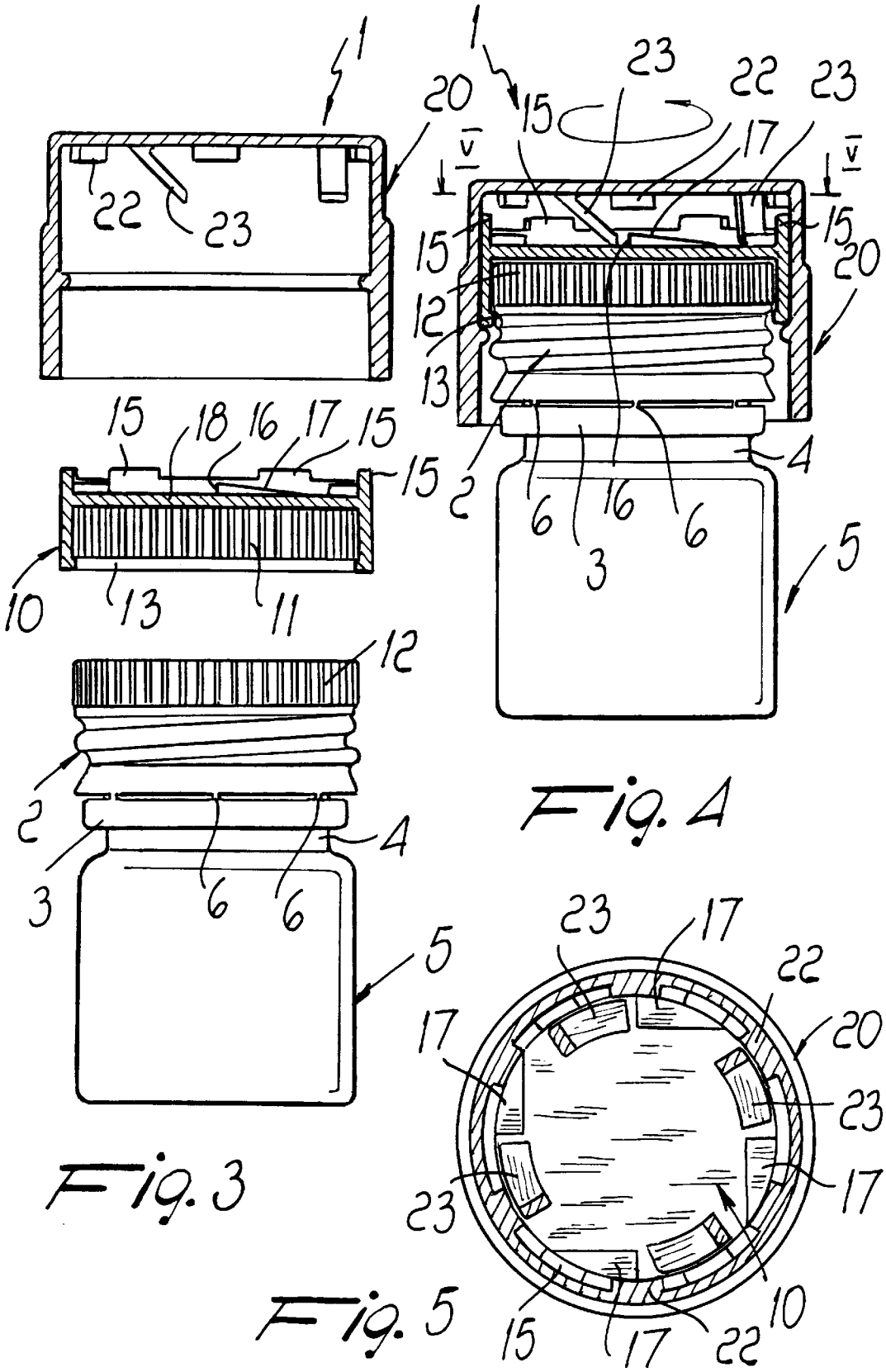
FIG. 3 is a sectional exploded view of the closure according to the invention applied to a bottle.
FIG. 4 is a sectional view of the closure applied to a bottle.
FIG. 5 is a sectional view, taken along the plane V—V of FIG. 4.

In greater detail, the hood 10 has, on its lower face, with reference to FIG. 3, an inner knurling 11 which rigidly rotationally couples to the outer knurling 12 of the cap 2.

In a downward region there is also provided an annular expansion 13 which, by engaging the narrower region of the metal cap 2 below the outer knurling 12, prevents accidental removal of the hood from the metal cap 2.

The hood has, on its upper face, a plurality of axial protrusions, designated by the reference numeral 15, and of raised portions 16, which have a wedge-like guiding portion 17 and are arranged at the outer bottom 18 of the cap 10.

Above the hood 10 and the cap 2 it is possible to apply an outer cap 20 which is preferably made of plastics like the hood 10; the outer cap is internally provided with an annular raised portion 21 which engages below the lower edge of the hood 10 to prevent accidental removal.

Inner teeth 22 are furthermore provided on the inner bottom of the cap 20 and can be mutually coupled to the axial protrusions 15, so as to rigidly rotationally couple the outer cap 12 and the hood 10.

There are also provided elastic means constituted by inclined elastic tabs 23 which rise from the inner bottom so as to correspond to the location of the raised portions 16.

The elastic elements act as an elastic axial spacer between the bottom of the outer cap 20 and the base of the hood 10, and are also capable of locking against the raised portions 16, so that it is easily possible to screw on the closure of the bottle, since the engagement of the elastic tabs 23 with the raised portions 16 rigidly rotationally couples the outer cap 20 and the hood 10 in the screw-on direction.

Figure 6:
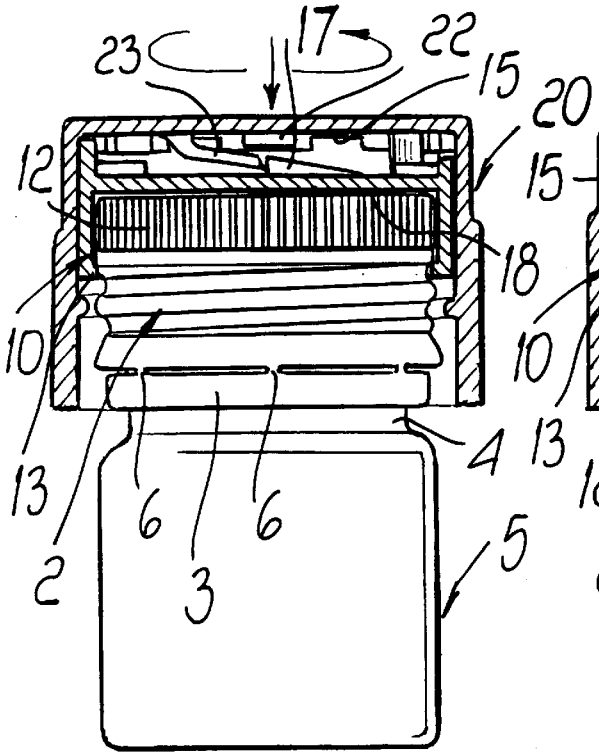
FIG. 6 is a schematic sectional view of the step for opening a closure.
Figure 7:
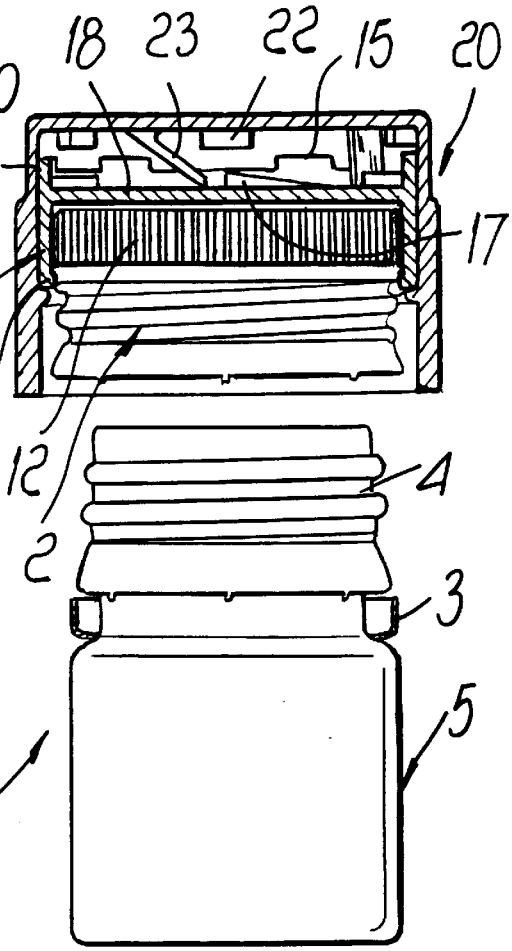
FIG. 7 is a sectional view of the closure separated from the bottle.
Figure 8:
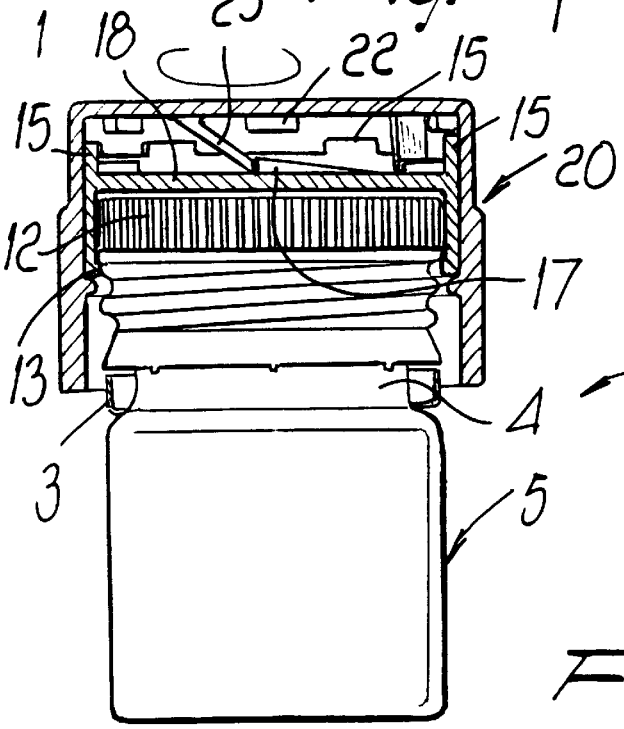
FIG. 8 is a sectional schematic view of the step for screwing the closure back onto the bottle.

With the above-described closure, to perform the opening action it is necessary to produce an axial compression, as shown in FIG. 6, so as to engage the inner teeth 22 with the axial protrusions 15 and rigidly rotationally couple the outer cap to the inner cap.

By then turning in the unscrewing direction, it is possible to easily break the bridges 6, providing easy opening.

To perform the closing action, as previously mentioned, it is sufficient to screw on the outer cap without any other complicated maneuver.

In particular, from the above description it is evident that with the described embodiment it is possible to provide an outer cap which is sufficiently rigid, so that it is not possible to also perform opening by radial compression; it is also possible to have easy opening, even in the case of the first opening action, since it is possible to use conventional bridges which can be provided by means of the aluminum cap and can be easily broken without having to apply particular efforts.

There is also the advantage that closure is performed easily, as allowed by closures provided by two plastic caps, which however do not allow to have a safety collar that can be broken easily and quickly.

In practice, the materials employed, so long as they are compatible with the specific use, as well as the contingent shapes and dimensions, may be any according to requirements.

What is claimed is:

1. A childproof closure for bottles in general with easier operation and improved safety, comprising a metal cap which can be screwed onto the neck of a bottle, a hood rigidly coupleable to said metal cap, and an outer cap, which can be superimposed on said metal cap and said hood, axial protrusions being provided on a base of said hood which can be detachably coupled to inner teeth formed by said outer cap, elastic means being furthermore provided for axially spacing the bottom of said outer cap and the base of said hood and being adapted to allow the engagement of said axial protrusions and of said inner teeth in order to rigidly rotationally couple said outer cap and said hood by applying axial compression to said outer cap, wherein said hood has, at a lower part, an inner knurling which can be coupled to an outer knurling formed on said metal cap, an annular protrusion being furthermore provided which can engage a narrower portion located below the outer knurling of said metal cap in order to prevent the removal of said hood from said metal cap.

2. The childproof closure according to claim 1, wherein said hood has, at an upper face, raised portions adapted to engage said elastic means in order to rigidly rotationally couple said outer cap to said hood during the screwing of said closure.

3. The childproof closure according to claim 1, wherein said outer cap has an annular abutment which can engage a lower edge of said hood to prevent the uncoupling of said outer cap from said hood.

4. The childproof closure according to claim 1, wherein said metal cap has a collar which is seamed to the neck of said bottle and is joined to said metal cap by means of breakable bridges.

* * * * *

UNITED STATES PATENT AND TRADEMARK OFFICE

CERTIFICATE OF CORRECTION

PATENT NO. : 6,085,920

DATED : July 11, 2000

INVENTOR(S) : Cesare Moretti

It is certified that error appears in the above-indentified patent and that said Letters Patent is hereby corrected as shown below:

On the title page, item:

[30] Foreign Application Priority Data

April 18, 1997 [IT] Italy ..... MI97A000926

Signed and Sealed this

Seventeenth Day of April, 2001

*Attest:*

Nicholas P. Godici

NICHOLAS P. GODICI

*Attesting Officer*

*Acting Director of the United States Patent and Trademark Office*